US006765165B1

(12) United States Patent
Torrens

(10) Patent No.: US 6,765,165 B1
(45) Date of Patent: Jul. 20, 2004

(54) ELECTRIC SWITCH

(75) Inventor: Eduard Torrens, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/707,550

(22) Filed: Dec. 20, 2003

(51) Int. Cl.[7] ..... H01H 1/10
(52) U.S. Cl. ..... 200/512; 200/5 R; 200/17 R
(58) Field of Search ..... 200/512, 5 R, 200/176, 17 R, 51.03, 51.05, 330, 345

(56) References Cited

U.S. PATENT DOCUMENTS 5,278,363 A * 1/1994 Krieg et al. ..... 200/5 R
5,384,440 A * 1/1995 Wnuk et al. ..... 200/5 R
5,442,149 A * 8/1995 Sato ..... 200/5 R
5,455,399 A * 10/1995 Kohno et al. ..... 200/341
5,844,182 A * 12/1998 Hirano et al. ..... 200/5 R
5,866,862 A * 2/1999 Riffil et al. ..... 200/5 R
6,252,183 B1 * 6/2001 Shirai ..... 200/5 R
6,611,120 B2 * 8/2003 Song et al. ..... 318/568.12

* cited by examiner

*Primary Examiner*—Lincoln Donovan
*Assistant Examiner*—K. Lee
(74) *Attorney, Agent, or Firm*—Bill C Panagos

(57) ABSTRACT

There is disclosed an electrical switch having an extremely simple structure allowing up to six contact positions, based on a slightly lengthened control having a button end and a shaft end, equipped to close a first pair different circuits when it is moved in one longitudinal direction of the other, to close a second pair of different circuits when one of its shaft sides tilts forward or backward, and finally to close a third pair of different circuits through similar forward or backward movement by its other shaft side.

5 Claims, 3 Drawing Sheets

ELECTRIC SWITCH

BACKGROUND OF INVENTION

1. Field of the Invention

This invention refers to a multiple contact electric switch, which allows a combination of up to six different electrical signals to be accessed, through the respective actions on one control unit. A switch in which the electrical contact is made through the use of a flexible membrane by said control unit.

The object of the invention is therefore to allow six different circuits to be controlled from one control unit, which in practice equates to activating six different devices.

The switch is particularly useful for use in the automotive industry, to control the different circuits of the electrical equipment of a vehicle.

2. Description of the Related Art

In the preferable field of practical application of the invention, that of vehicles, the number of features and controls that vehicles offer the driver is ever greater, so that the number of activation controls required for this purpose is also ever greater.

At the same time there is a tendency to limit the number of controls, both for operational simplification and economic reasons, so that from a single control unit, different circuits can be controlled.

One of the usual solutions involves the use of sequential switches, so that each keystroke acts on a circuit, but this type of switch is only valid for extracting information, as in order to access a certain option it is necessary to pass through the options that separate it from the currently active option, so that on occasion and in order to reach certain information, it may be necessary to make a considerable number of keystrokes. When the intention is to control the vehicles functions, an action of this type is not viable as it would involve the need to act on unwanted circuits, in order to reach the one it is intended to activate or deactivate.

There are known multiple switches whose activating control is able to move in different directions, but these switches are usually limited to four circuits, where the control button tilts on four equiangular distributed points on its periphery, and at best five circuits, by means of activation centered on the switch, which does not tilt laterally but moves axially.

DISCLOSURE OF THE INVENTION

The switch of the invention, has an extremely simple structure, as will be seen below, allowing the number of contact positions to be increased, specifically up to six, based on a slightly lengthened control having a button end and a shaft end, equipped to close a first pair different circuits when it is moved in one longitudinal direction or the other, to close a second pair of different circuits when one of its shaft sides tilts forward or backward, and finally to close a third pair of different circuits through similar forward or backward movement by its other shaft side.

Obviously the switch may be used for a lesser number of circuits, when desired, simply by disabling the contact or contacts which are unnecessary.

In order to do this, and to be more specific, said switch is structured on the basis of said control, which with identifying exterior signals from the different actions planned for it, adopts the configuration of a housing which allows the pressured coupling of a button equipped with a shaft in its centre, which by going through the fixed body of the switch penetrates the housing configured with the control, a shaft finished off in a board parallel to the body and situated below it, the board equipped with three pairs of sidepieces designed to act on a membrane conveniently fixed to the printed circuit board where the different circuits to be controlled are established.

The hole through which the shaft of the button passes is conveniently sized to limit the transverse movements of the shaft and consequently the movements of the control, and the lower membrane has a number of contact areas with a straight trapezium profile, which in turn form three pairs, so that between each of them one of the pairs of sidepieces of the button is housed, so that this desired configuration of the contact areas of the membrane means that when they undergo a lateral action they are flexed vertically, that is to say towards the printed circuit board, causing the closing of the respective circuit.

Logically each contact area of the membrane will include on its lower side, the side facing the printed circuit board, a pad made of any appropriate conductive material which may even be a simple coat of conductive ink, which in a rest position is separated from the printed circuit board, and makes contact with the printed circuit board when it is deflected by the control button.

There is presented in one aspect of the invention an electrical switch having six contact positions activated by a single switch button comprising: an electrical switch body having an opening therein for passage of a button shaft and being fixedly attached to a printed circuit board; a printed circuit board having two surfaces, one surface facing the opening in said electrical switch body and having disposed thereon a plurality of electro-conductive pads capable of acting as electrical switches; a button plate having two surfaces, one surface facing the printed circuit board surface having three pairs of side pieces each of said side pieces, said button plate second surface having mounted thereon a button shaft capable of passing through the opening in said electrical switch body and further being under dimensioned allowing said button shaft to move transversely in relation to said electrical switch body within the confines of said opening in said body; a flexible membrane located between said button plate and said printed circuit board and having on its surface facing said button plate three pairs of tabs having straight trapezoidal profile and each pair of tabs facing each other through their larger bases defining a space for locating a corresponding pair of said three pairs of side pieces on said button and further being characterized as having on the lower heel portion of each tab being equipped with an electro-conductive pad designed to act upon one of said plurality of electro-conductive pads on said printed circuit board; and a button mounted on said button shaft end extending from said electrical switch body opening for activating a desired one of said plurality of plurality of electro-conductive pads.

DETAILED DESCRIPTION

Figure 1:
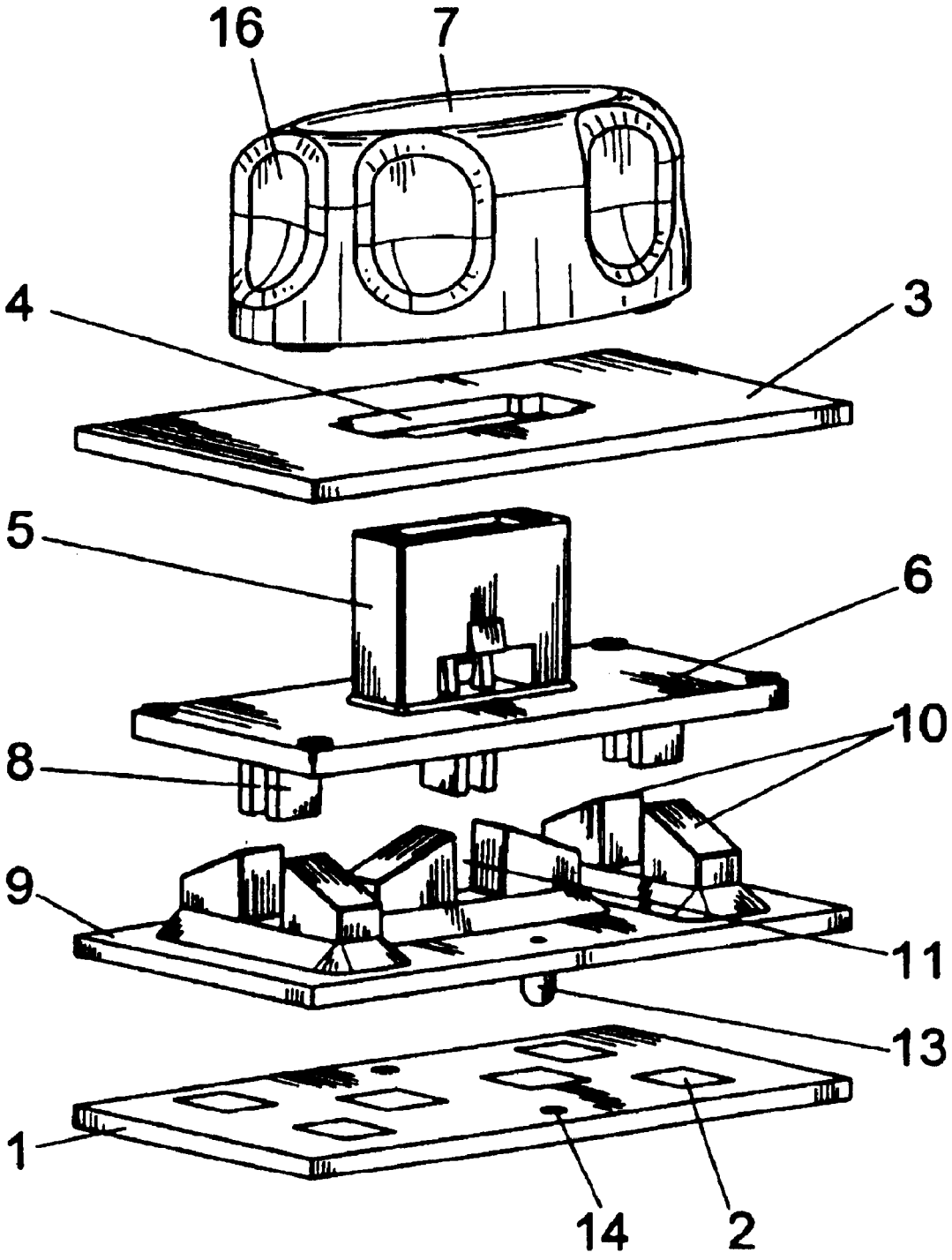
FIG. 1 shows an exploded perspective view of an electric switch with six contact positions made in accordance with the present invention.
Figure 2:
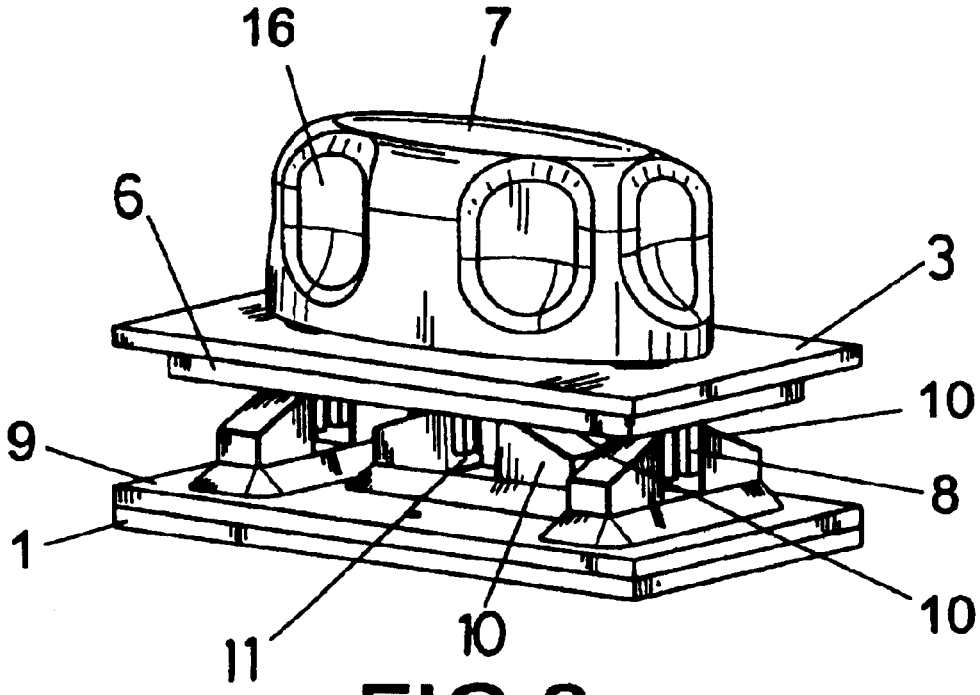
FIG. 2 shows a perspective view of the same group of components shown in FIG. 1 assembled.

From the figures it can be seen how the switch of the present invention has been conceived for printed circuit boards (1), equipped with a plurality of commonly named "pads" (2) which on being bridged with a conductive element, closes the related circuit.

The switch takes the form of a body (3) fixedly attached to the printed circuit board (1), in order that its relative position is kept stable, said body (3) being equipped with an opening (4) through which the shaft (5) of a button plate (6) passes and being located within body (3) communicating by way of said shaft (5) to the exterior of said body (3) in order to receive the related button (7), which logically must remain accessible outside said body (3).

Thus button (7) communicates by way of shaft (5) with a button plate (6) equipped on its lower side with three pairs of side pieces (8). Said side pieces (8) are designed to act on a membrane (9) when activated by the button (7). Said three side pieces (8) in turn communicate with three pairs of tabs (10), said tabs (10) having a straight trapezoidal profile, so that each pair of said tabs (10) face each other through their larger bases, a space (11) being defined between them in which the respective pair of side pieces (8) fit, as can be seen in figure (4). Each pair of said tabs (10) of the membrane (9) having a lower heel (12) which, equipped with an electro-conductive pad, is designed to act on the "pad" (2) located on printed circuit board (1), closing the related circuit.

The membrane (9) is mounted on the printed circuit board (1) by way of a pair of registration pins (13) located on said membrane (9), which engage respective holes (14) in the printed circuit board (1).

Figure 3:
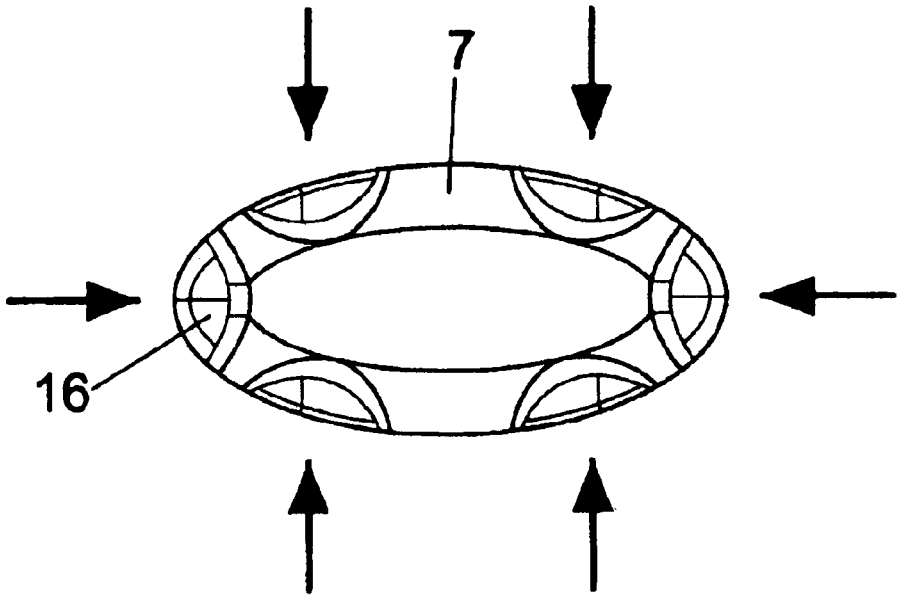
FIG. 3 shows a top plan view of the switch control activation button where arrows show the activation directions used to achieve the six contact positions.
Figure 4:
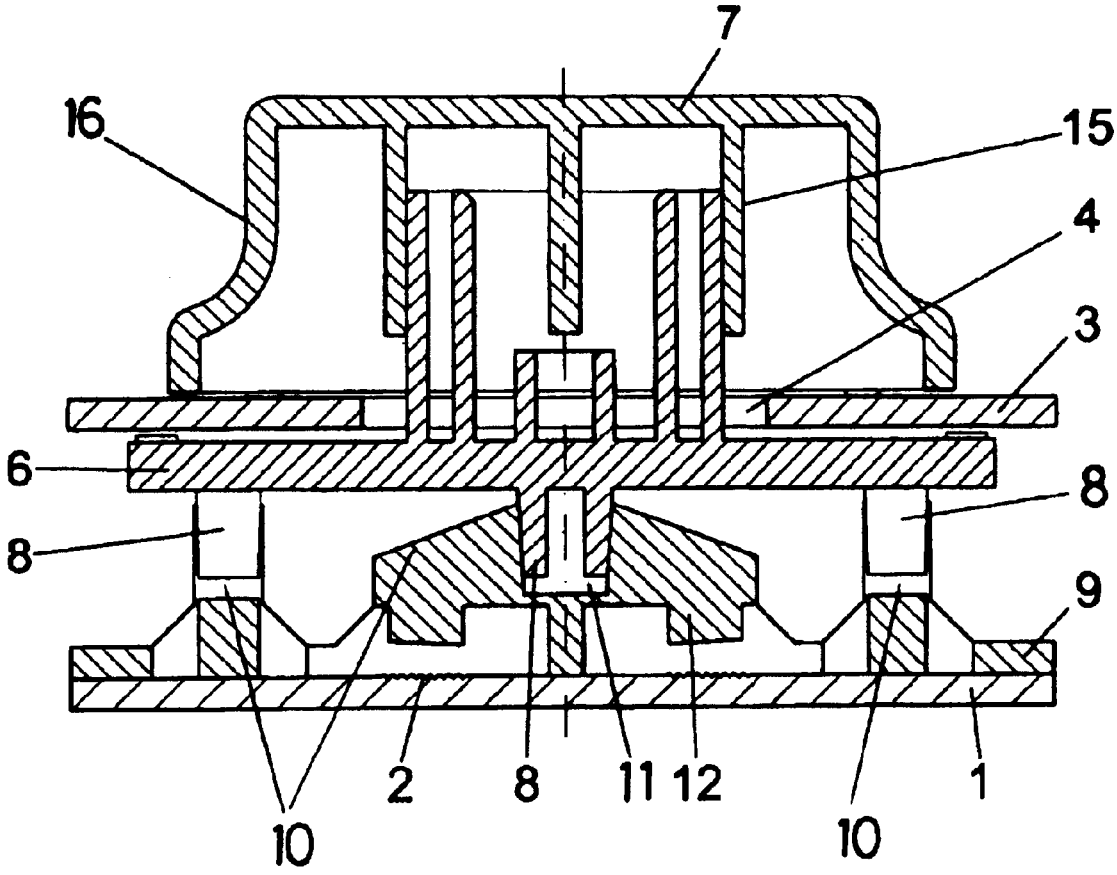
FIG. 4 shows a cross section plan view of FIG. 2.

Referring again to the button (7), said button (7) is coupled to the shaft (5) of the button plate (6) by a simple pressure fitting, as can be seen in FIG. 4. Particularly, said button (7) having a kind of housing with interior walls (15) providing a housing into which the aforementioned shaft (5) seats tightly under pressure. Said shaft (5) further defined as being under dimensioned in relation to the window (4), as can also be seen in FIG. 4, allowing said shaft (5) to move transversely in relation to the body (3), within limits pre-established by the dimensions of the window (4). The membrane (9) being distorted causing closing of the pad (2) and thereby closing the electrical circuit associated therewith. Upon removal of the distortion of the membrane (9), membrane (9) returns to its original non-distorted position thereby causing the pad (2) to return to its normally non-conductive condition stopping any signal through the associated electrical circuit. The facets (16) of button (7) defining the different functional possibilities, two longitudinal and the four transverse movement possibilities as shown in FIG. 3.

Although the preferred embodiments of the present invention has been disclosed, various changes and modifications may be made without departing from the scope of the invention as set forth in the appended claims.

What is claimed is:

1. An electrical switch having six contact positions activated by a single switch button comprising:

an electrical switch body having an opening therein for passage of a button shaft and being fixedly attached to a printed circuit board, a printed circuit board having two surfaces, one surface facing the opening in said electrical switch body and having disposed thereon a plurality of electro-conductive pads capable of acting as electrical switches;

a button plate having two surfaces, one surface facing the printed circuit board surface having three pairs of side pieces each of said side pieces, said button plate second surface having mounted thereon a button shaft capable of passing through the opening in said electrical switch body and further being under dimensioned allowing said button shaft to move transversely in relation to said electrical switch body within the confines of said opening in said body;

a flexible membrane located between said button plate and said printed circuit board and having on its surface facing said button plate three pairs of tabs having straight trapezoidal profile and each pair of tabs facing each other through their larger bases defining a space for locating a corresponding pair of said three pairs of side pieces on said button and further being characterized as having on the lower heel portion of each tab being equipped with an electro-conductive pad designed to act upon one of said plurality of electro-conductive pads on said printed circuit board; and a button mounted on said button shaft end extending from said electrical switch body opening for activating a desired one of said plurality of plurality of electro-conductive pads.

2. An electric switch as claimed in claim 1, wherein said opening in said electrical switch body is oversized in relation to said button shaft, acting as a movement limiter for said button plate against said flexible membrane.

3. An electric switch as claimed in claim 1 wherein, said flexible membrane has two positioning pins that mount in a pair of corresponding bores on said the printed circuit board.

4. An electric switch as claimed in claim 1 wherein, one of said three pairs of said tabs on said flexible membrane is situated centrally and aligned longitudinally, and the other two pairs of said tabs are positioned on either side of said centrally positioned pair of tabs are aligned transversely, so that they act on the respective circuits when said button is activated.

5. An electric switch as claimed in claim 1, wherein said switch has six electro-conductive pads.

* * * * *